US007556040B2

(12) United States Patent
Meyer et al.

(10) Patent No.: US 7,556,040 B2
(45) Date of Patent: Jul. 7, 2009

(54) HYPERBARIC THERAPY CAPSULE

(75) Inventors: Allan Dolph Meyer, Cherrybrook (AU); Norman Michael Berry, Cherrybrook (AU); Martin James Davidson, Newtown (AU)

(73) Assignee: Oxygen Therapy International Pty Ltd., Queensland (AU)

( * ) Notice: Subject to any disclaimer, the term of this patent is extended or adjusted under 35 U.S.C. 154(b) by 0 days.

(21) Appl. No.: 10/531,497

(22) PCT Filed: Nov. 19, 2003

(86) PCT No.: PCT/AU03/01540

§ 371 (c)(1),
(2), (4) Date: Dec. 30, 2005

(87) PCT Pub. No.: WO2004/047710

PCT Pub. Date: Jun. 10, 2004

(65) Prior Publication Data

US 2006/0169284 A1 Aug. 3, 2006

(30) Foreign Application Priority Data

Nov. 22, 2002 (AU) ..... 2002952811

(51) Int. Cl.
*A61G 10/00* (2006.01)
*A62B 31/00* (2006.01)

(52) U.S. Cl. ..... 128/205.26; 128/202.12; 128/202.13; 128/202.16; 128/202.19; 600/19; 600/20; 600/21; 600/22; 292/44; 292/52; 292/95; 292/118; 292/100; 292/217; 292/200

(58) Field of Classification Search ..... 128/205.26, 128/202.12, 202.16, 202.19, 202.13; 600/19–22; 292/44, 52, 95, 118, 100, 217, 200
See application file for complete search history.

(56) References Cited

U.S. PATENT DOCUMENTS

| | | | | |
|---|---|---|---|---|
| 4,509,513 | A | | 4/1985 | Lasley |
| 4,727,870 | A | | 3/1988 | Krasle |
| 4,811,729 | A | | 3/1989 | Sands et al. |
| 4,828,207 | A | * | 5/1989 | Haynes ..... 244/171.7 |
| 5,109,837 | A | | 5/1992 | Gamow |
| 5,255,673 | A | | 10/1993 | Cardwell et al. |
| D346,864 | S | | 5/1994 | Reneau |
| 5,327,904 | A | | 7/1994 | Hannum |
| 5,360,001 | A | | 11/1994 | Brill et al. |
| 5,398,678 | A | | 3/1995 | Gamow |
| 5,433,334 | A | | 7/1995 | Reneau |

(Continued)

FOREIGN PATENT DOCUMENTS

RU 2056825 C1 3/1996

(Continued)

*Primary Examiner*—Patricia M Bianco
*Assistant Examiner*—Nihir Patel

(57) ABSTRACT

A hyperbaric capsule has a base forming a seat that can be enclosed by an elongate oval canopy having a large transparent window formed therein. The bottom of the front of the canopy is pivotally attached to the front of the base by a hinge assembly and can be locked in the closed position on the base by a plurality of latches that are conjointly operated by an external lever and an internal lever. The weight of the canopy upon opening is borne by a pair of side gas or spring struts.

18 Claims, 11 Drawing Sheets

U.S. PATENT DOCUMENTS

| | | | | |
|---|---|---|---|---|
| 5,645,578 | A | 7/1997 | Daffer et al. | |
| 5,738,093 | A | 4/1998 | Santi | |
| D401,342 | S | 11/1998 | Allen | |
| D415,278 | S | 10/1999 | Bowman | |
| 6,016,803 | A | 1/2000 | Volberg et al. | |
| 6,224,018 | B1 * | 5/2001 | Hinestroza | 244/121 |
| 6,321,746 | B1 | 11/2001 | Schneider et al. | |
| 6,352,078 | B1 | 3/2002 | Harvey et al. | |
| 6,354,457 | B1 | 3/2002 | Aaron | |
| 6,702,767 | B1 * | 3/2004 | Douglas et al. | 601/15 |
| 6,814,076 | B2 | 11/2004 | Shusterman et al. | |

FOREIGN PATENT DOCUMENTS

| | | | |
|---|---|---|---|
| RU | 2112486 | C1 | 6/1998 |

* cited by examiner

HYPERBARIC THERAPY CAPSULE

TECHNICAL FIELD

This invention relates to a chamber suitable for use by a person for hyperbaric oxygenation for therapy, prophylaxis or general health improvement. It is particularly, though not exclusively, concerned with a hyperbaric capsule suitable for use by one person at home, or for use by a clinic for the treatment individual clients. The capsule may be used with or without oxygen enrichment of air breathed by the user.

This invention also relates to methods for operating such capsules to ensure efficacy and safety.

BACKGROUND TO THE INVENTION

Hyperbaric chambers known in the art are commonly designed for the recompression of divers to mitigate gas embolism, the treatment of patients in a hospital or clinic environment and for diver or athlete training. In much of the art known to the applicant, hyperbaric chambers are massive and complex devices that require expert attendant staff. Such chambers are therefore not suited for home use by individuals without attendants. Moreover, since expert staff will be in attendance while the hyperbaric chambers of the art are in use, no provision is made for the user or patient to open the chamber from within so that he or she can exit without assistance.

In many hyperbaric chambers for use in the clinical environment the patient is required to lie prone in a tube. Indeed, it is important in recompression chambers for the patient to be prone and inclined head-down at an angle of about 30 degrees. This results in the massive construction typical of many such chambers. [See, for example, U.S. Pat. Nos. 4,727,870 to Krasel, 5,433,334 to Reneau and 6,354,457 to Aaron, and U.S. design Pat. Nos. 346,864 to Reneau and 415,278 to Bowman.] However, it is also important that recompression chambers be capable of being transported to a diver with the bends and rapidly deployed on site. Relatively compact chambers suitable for transport by truck or plane are therefore known in the art. [See, for example, U.S. Pat. Nos. 4,811,729 to Sands et al, 5,378,093 to Santi and 6,321,746 to Schneider. For relatively modest recompression pressures, portable inflatable chambers with flexible walls are also known in the art. [See, for example, the above U.S. patents to Santi and Schneider as well as U.S. Pat. Nos. 5,109,837 and 5,398,678 and to Gamow, 5,255,673 to Cardwell and 5,360,001 to Brill.]

The traditional design of a hyperbaric chamber for use in hospitals and clinics is a cylinder with a round door at one end through which the patient can be introduced in the prone position. Such a design appears to have been dictated by the need to minimize the area of the end door so that the force on the door is modest even when the chamber is fully pressurized. Nevertheless, many such chambers have the appearance and claustrophobic feel of totally enveloping 'iron lungs' that prevent the patient from moving significantly—let alone sitting up—and that allow visual contact with the operators through small portholes only. [See, for example, U.S. patent to Krasel above.] The fact that there is generally no way that the user can open the chamber from within exacerbates the natural claustrophobic anxiety associated with enclosure in such a confined space.

Nevertheless, the prior art does disclose designs for hyperbaric chambers that permit the patient to be seated. U.S. Pat. No. 5,327,904 to Hannum and U.S. Pat. No. 6,352,078 to Harvey disclose short cylindrical chambers of sufficient diameter to accommodate a seated person. In the former case a flat door is fitted into the cylindrical shell and in the latter case the door is set into one end. In both cases, however, the doors open inwards (to enhance strength and facilitate sealing under pressure). Since the open door must allow the user entry and, after entry, must clear the seated user as it is being closed, the size of the chamber still needs to be substantial. Hannum nevertheless notes that an important feature of his chamber is that can be made sufficiently compact to fit through double (hospital) doors. Again, both chambers require the attendance of a skilled operator throughout the treatment of the patient or user, including the opening of the door to permit entry and egress at the start and end of the procedure. Thus neither chamber is suited to home use, for installation in a normal house or for use by a person without assistance.

Finally, it is to be noted that U.S. Pat. No. 4,509,513 to Lasley discloses a 'hyperbaric chamber' that appears to be suitable for home use by a person without assistance. However, the device is a bag into which the user climbs like a pair of angler's waders, securing the opening around the upper part of the body (below the shoulders and not including the arms) to form a seal. The bag is then inflated with oxygen-enriched air. Obviously this device is not, in fact, a hyperbaric chamber in the normal sense—that is, one intended for pulmonary oxygenation.

OUTLINE OF THE INVENTION

From one aspect, this invention is a hyperbaric capsule that has (i) an elongate base molding which incorporates the form of a chair and which extends forward from the chair at user foot level and upward above user head level at the back of the chair and (ii) and elongate canopy that extends forward and downward from above user head level. The canopy has an elongate transparent window and is moveable between an open position, where a user can freely move to and from the chair via the side of the capsule, and a closed position where a seated user is fully enclosed by the canopy and base, which together form a hyperbaric chamber. The base molding and the canopy define respective seal-lines that cooperate to form an air-tight seal between the base and the canopy when the canopy is closed. Preferably, the canopy and its window have convex external surfaces that are curved in both the front-to-back and the side-to-side directions, the window preferably extending from at least user head level to the level of the seat of the chair.

The capsule is preferably fitted with latches for securing the canopy to the base at a plurality of points about its periphery, the latches preferably being operable in unison by an actuator located within the capsule and an actuator located outside the capsule. The latches may take the form of hooks mounted on the ends of shafts, which extend transversely through the base, and coacting latch pins mounted on the canopy. The arrangement may be such that outward movement of the canopy sides under pressure is resisted by the hooks and their shafts. However, it is also envisaged that the sides of the canopy may fit within the periphery of the base so that outward movement of the canopy sides is also resisted directly by the periphery of the base. Preferably, where hooks are used as the latches, they have an over-center action whereby an opening force applied to the canopy acts to bias the hooks further toward their secure or closed positions, thereby inhibiting operation of the actuators to effect the opening of the canopy while it is under pressure.

The chair will normally comprise a back adapted to support the back of the user at a comfortable angle to the vertical and a seat adapted to support the buttocks of the user at a comfortable angle to the horizontal. The base of the capsule preferably includes a floor in front of and below the chair seat adapted to support and accommodate the feet of a seated user. The base, the floor and the seat and back of the chair are preferably all molded integrally from fiber-reinforced plastics material to incorporate a metal base frame to withstand the operating pressure of the capsule. The peripheral base seal-line is preferably made up of (i) a first generally horizontal U-shape periphery that extends from the seat on each side of the chair and around the front foot area of the base, and (ii), a second generally vertical inverted U-shape periphery that extends from below the seat on each side and over the back of the chair. The first and second U-shape peripheries of the base join at an angle below the seat to complete the base seal line. The canopy has downwardly extending triangular side portions that have a corresponding angle so that they will fit into the join of the first and second U-shape peripheries of the base.

With this form of canopy and base, it is preferable for multiple hook-form latches to be arranged around the join between the two U-shape peripheries of the base and for their corresponding latch pins to be arranged in the triangular portions of the canopy, so that lateral movement of the side portions under pressure is resisted in the manner noted above To doubly ensure that the canopy cannot be flung open forcefully by premature release of the latch means, a pressure-operated lock may be fitted to prevent operation of the actuator as long as pressure within the capsule is greater than that outside. Preferably, this lock is operable within the capsule so that it can be moved manually by a person in the capsule in the event that it does not automatically release after the capsule is depressurized.

The canopy is preferably of a dished elongate oval shape that (when closed) encompasses the base from the floor area to the top of the chair back. It can be formed from a thick sheet of highly transparent thermoplastic material by applying heat and fluid pressure—without the need for a mold—to generate the desired shape. Since the transparent portion of the canopy can extend in the front-to-back direction from over the head to near the feet of a seated user and, in the side-to-side direction, over the width of the user's body, there is little sense of claustrophobia. An edging of fiber-reinforced plastic material can be applied to the periphery of the canopy to form the canopy seal line and to mount the latch pins and other fittings (such as hinges and gas struts).

The canopy is preferably hingedly attached to the base at the front of the foot area so that it can pivot forwards to allow ready ingress and egress of the user from the at least one side of the capsule. The weight of the canopy may be supported in the open or partially open position by the use of gas struts or the like located at the front of the canopy on each side near of the floor. A flexible rubber-like sealing ring can be readily fitted to the periphery of the canopy and/or that of the base to ensure a substantially hermetic seal therebetween along the respective seal-lines of the base and the canopy, when the canopy is closed.

It will be appreciated that a capsule of the type described can be readily made to be small enough to fit through the standard doorways of a normal domestic dwelling and to be handled by one or two installers, particularly if the base is provided with wheels. However, because of its small size and volume, it is desirable that there be adequate provision for heat and $CO_2$ removal. This may be achieved by ensuring sufficient flow of pressurized air through the capsule while it is in use. The pressurized air may be conditioned to user-controlled temperature and humidity. Additionally, heat-exchanger means may be provided to cool the base or chair of the capsule.

If oxygen supplementation is required, it will generally be most safe and economical for the user to employ an oxygen mask while sitting in the capsule. Alternatively, the input air to the capsule can be enriched with oxygen.

With single-person use in mind, it is desirable that pressure, temperature and air/$O_2$ flow controls and/or indicators are located conveniently within the capsule, preferably on the base thereof or on a lower portion of the canopy. Various audible and/or visual alarms may also desirable; for example, a power-failure alarm, an excess temperature alarm, and an excess $CO_2$ alarm. Preferably, these indicator, controls and alarms are duplicated on the exterior of the capsule. The activation of any of the alarms may be arranged to automatically depressurize the capsule and even to operate the actuator to release and 'pop' the canopy. A standby pressure vessel or electric battery may be needed to effect such functions despite a mains power failure.

DESCRIPTION OF EXAMPLES

Having portrayed the nature of the present invention, a particular example will now be described with reference to the accompanying drawings. However, those skilled in the art will appreciate that many variations and modifications can be made to the example, and many other examples can be devised, without departing from the scope of the invention as outlined above. In the accompanying drawings:

FIG. 10A is a side elevation of the canopy and base frames in the open position showing a first alternative latching arrangement, while

FIG. 11A is a side elevation of the canopy and base frames in the closed position showing detail of a second alternative latching arrangement, while

Figure 1:
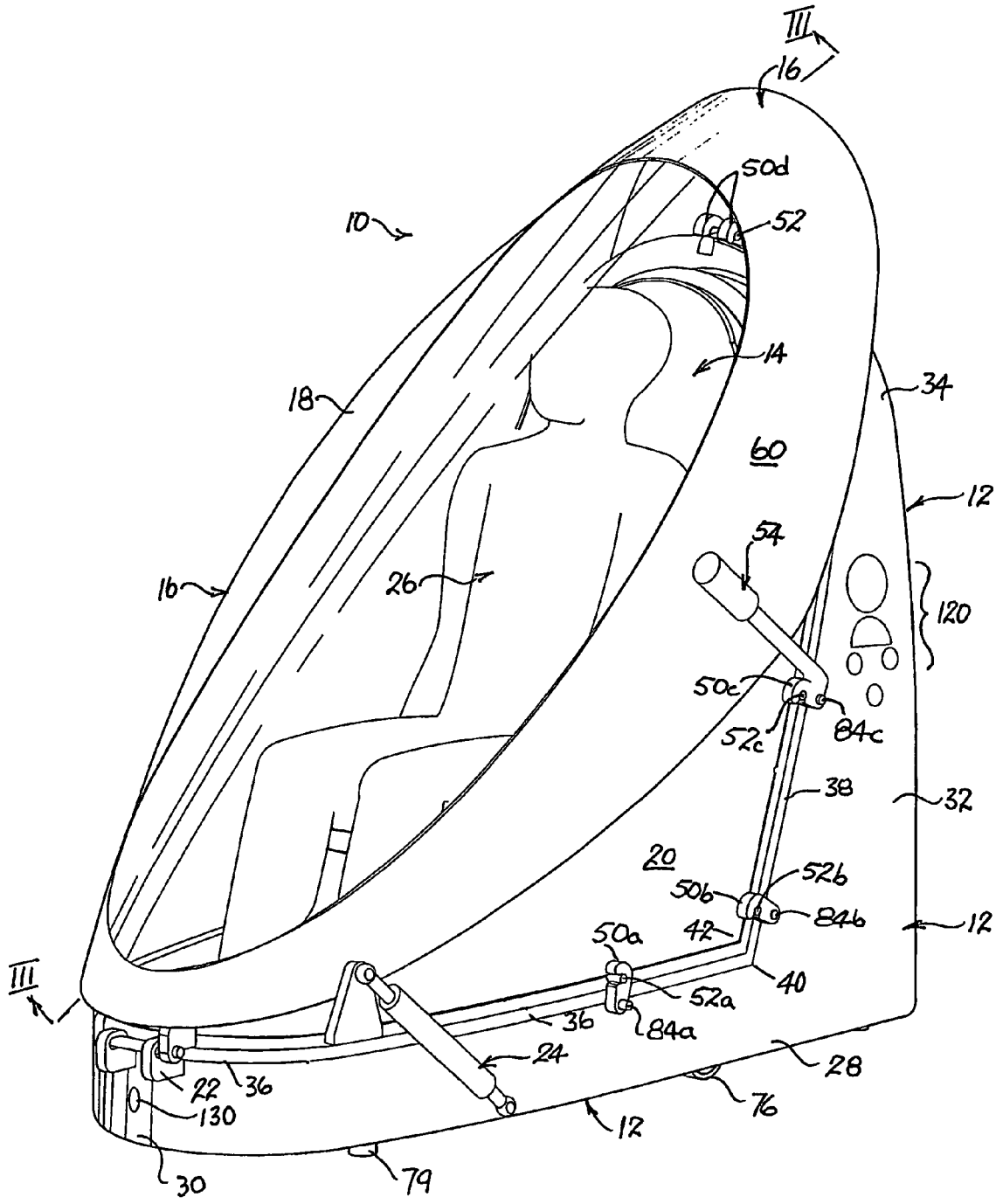
FIG. 1 is a perspective view of the capsule of the chosen example with the canopy closed and a user seating inside.
Figure 2:
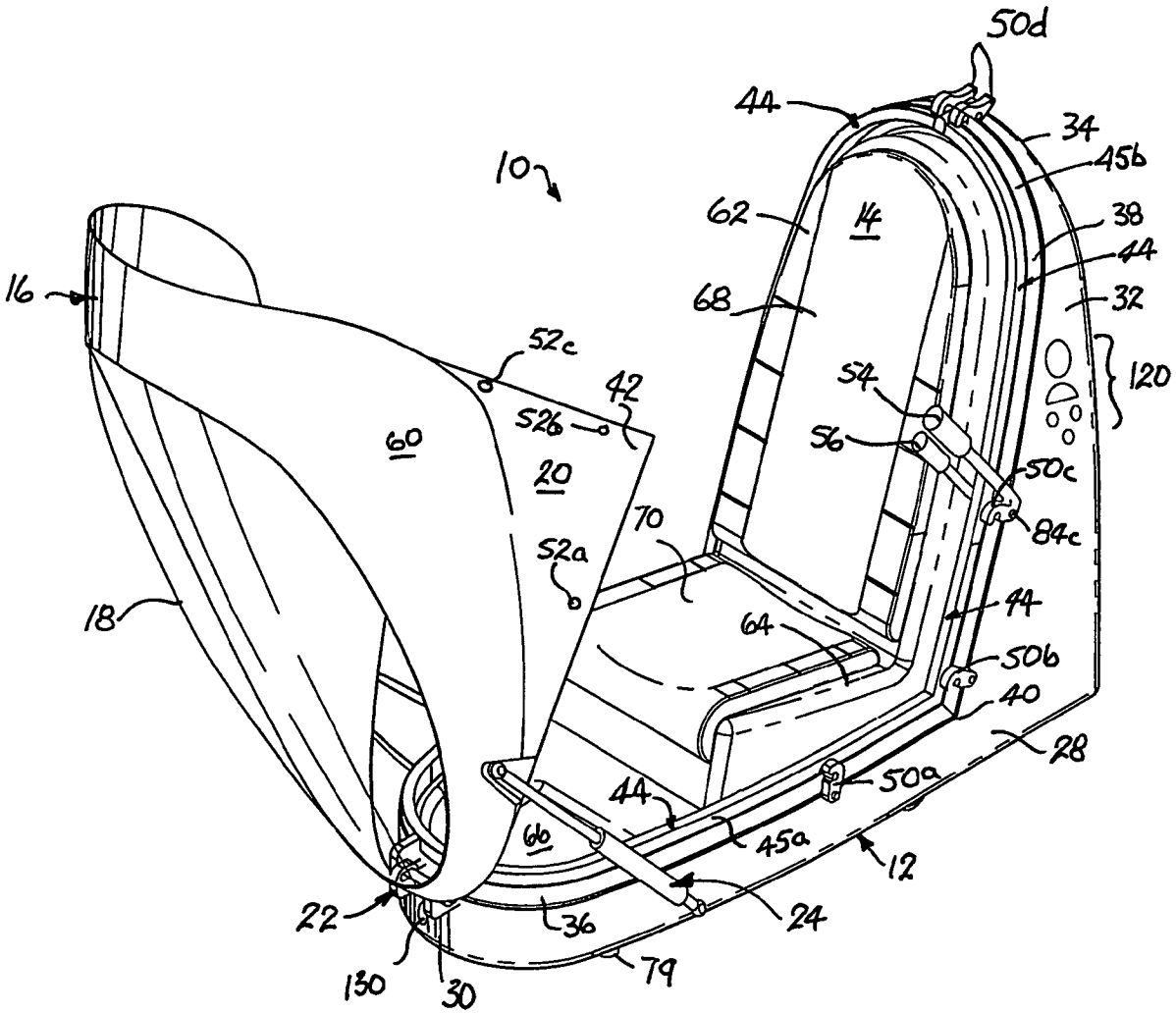
FIG. 2 is a perspective view of the capsule of FIG. 1 with the canopy open and no user visible.
Figure 3:
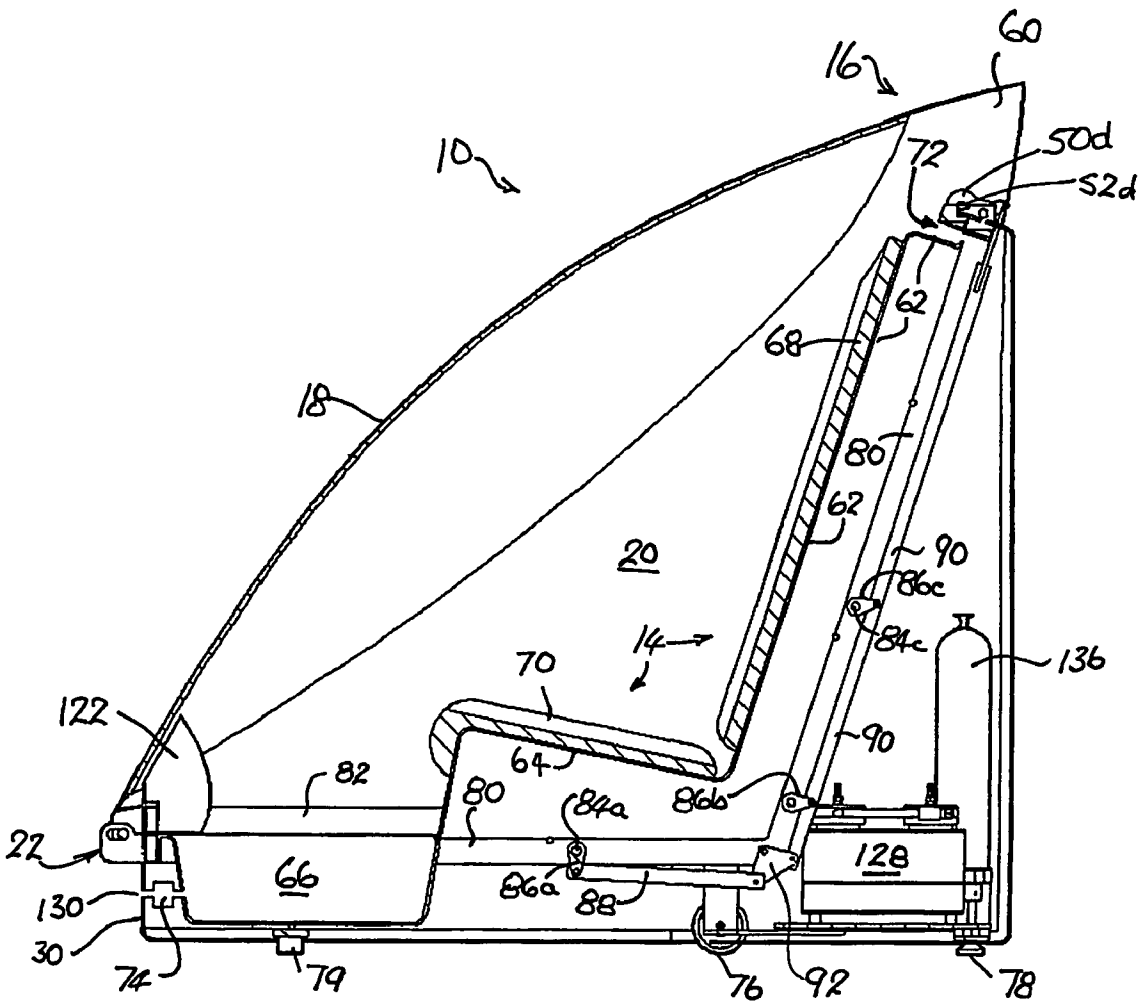
FIG. 3 is a longitudinal cross-section of the closed capsule taken on plane III-III of FIG. 1, the user not being shown.
Figures 4A, 4B, 4C:
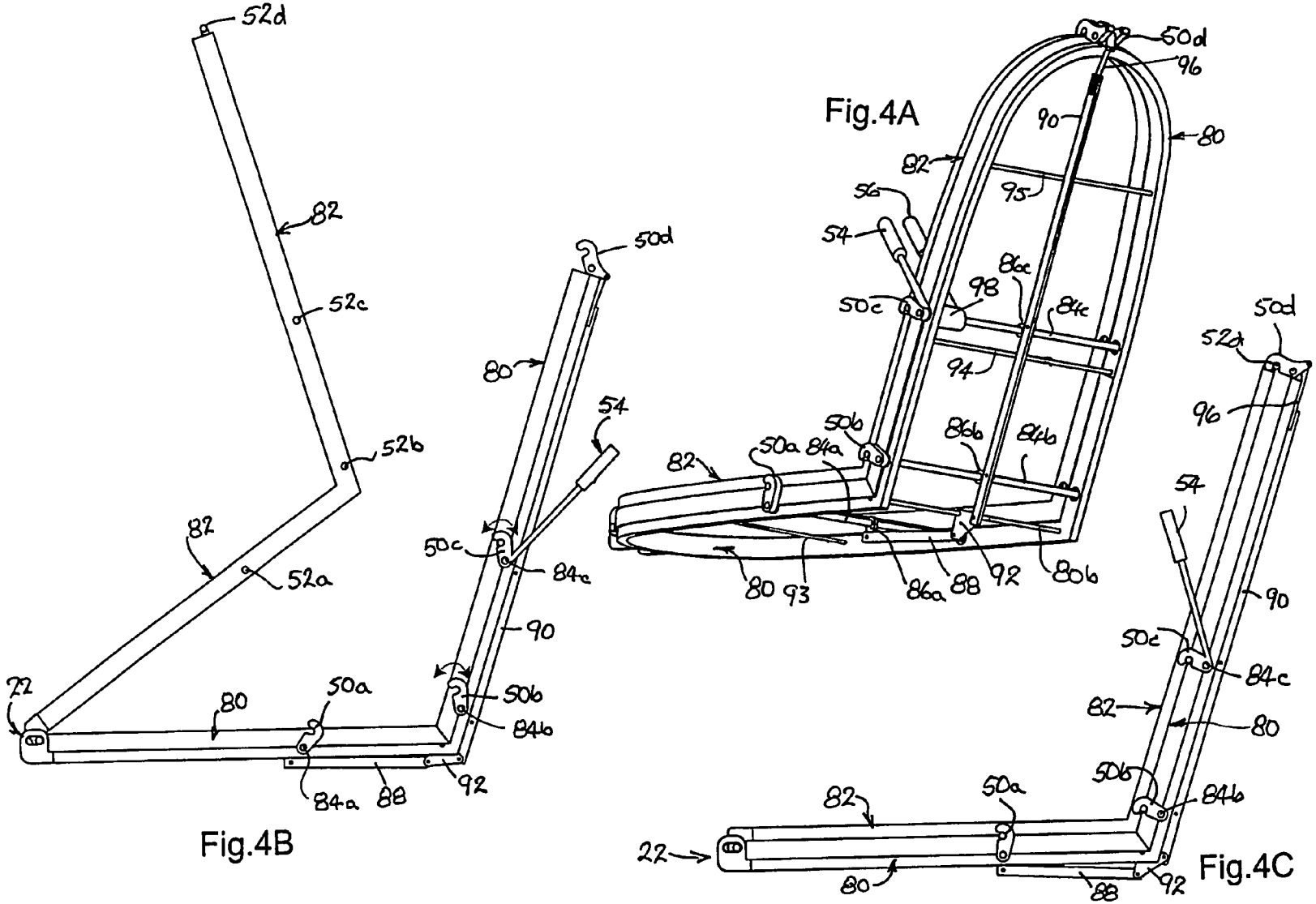
FIG. 4A is a perspective view of the underside of base and canopy frames with the canopy frame in the closed position, showing the manner in which the multiple latches are operated in unison.
FIG. 4B is a side elevation of the base and canopy frames of FIG. 4A with the canopy frame in a half open position.
FIG. 4C is a side elevation of the base and canopy frames of FIGS. 4A and 4B with the canopy frame shown in the closed and latched position.

Turning to FIGS. 1, 2 and 3, the basic components of the capsule 10 of the chosen example include a molded base 12, which includes an integrally-molded chair 14, and a curved downward and forwardly sloping canopy 16, which includes a large elongate and convex oval transparent window 18 and depending generally-planar triangular panels 20 on each side. Canopy 16 is curved both from side-to-side and from front-to-back and is pivotally attached at the lower front to the front of base 12 by a hinge assembly 22. A gas strut 24 on each side near hinge assembly 22 is designed to both take the weight of canopy and limit the rate at which it can be swung open or closed. In FIGS. 1 and 3, canopy 16 is shown closed, while in FIG. 2, it is shown open. The outline of a person 26 seated on chair 14 is indicated in FIG. 1, but not in FIGS. 2 and 3.

In this description it will be convenient to refer to the space enclosed by canopy 16 and base 12 as the hyperbaric chamber—since it can be pressurized—and to refer to the entire device as the capsule.

As best seen from FIG. 2, base 12 has a generally horizontal bottom 28 with a curved front portion 30 and a generally upright back 32 with a curved top 34 portion. Bottom 28 (including curved front portion 30) defines a generally horizontal U-shape that has an upward-facing peripheral edge 36, while back 32 defines a generally vertical U-shape that has a forward-facing peripheral edge 38. The rear of bottom peripheral edge 36 joins the bottom of back peripheral edge 38 at an angle indicated at 40, which corresponds to the angle indicated at 42 of triangular side portions 20 of canopy 16.

While peripheries 36 and 38 could form a continuous peripheral seal-line against which a sealing strip fitted around the inside of canopy 16 could rest, in this example the continuous seal-line 44 is formed by the faces of shoulders 45*a* and 45*b* that up-stand from peripheral edges 36 and 38 (respectively). A flexible resilient seal-strip 47 (FIGS. 2 and 6A and 6B) is fitted around the entire internal periphery of the canopy so that it engages with base 12 inboard of canopy 16. The arrangement is such that, when canopy 16 with attached seal-strip 47 is lowered onto base 12 to the closed position (as in FIG. 1), seal-strip 47 is brought to rest against shoulder 45*a* of bottom 28 of base 12 and against shoulder 45*b* of back 32 of base 12. Thus, internal pressure in capsule 10 will press seal-strip 47 downwards into sealing contact with bottom 28 and backwards into sealing contact with back 30. [This is shown and described in more detail with reference to FIGS. 6A and 6B.]

After being lowered to its closed position, canopy 16 can be secured to base 12 by pivoting side hook-like latches 50*a*-50*c* on each side of base 12 to engage corresponding latch pins 52*a*-52*c* each side of canopy 16. A pair of pivoting top hook-like latches 50*d* engage a common latch pin 52*d* (FIG. 2) located inside the top rear of canopy 16. Latches 50*a*-50*d* are mechanically linked (in a manner to be described) so as to operate in unison, latch 50*c* (FIGS. 1 and 2) being formed on the lower end of an external actuator or handle 54. Handle 54 is secured to a transverse shaft 84*c* (to be further described) that passes through back 30 of base 12 and is connected for conjoint operation with an internal handle 56. Thus, latches 50*a*-50*d* can be operated in unison by person 26 seated in the capsule using handle 56 or by a person outside the capsule using handle 54.

The peripheral edges 36 and 38 of base 12 thus define a recess around base 12 within which the linear peripheral edges of triangular sides 20 of canopy 16 are located when the canopy is closed.

The window 18 of canopy 16 is joined to triangular side panels 20 by a curved fiber-reinforced plastic [FRP] skirt 60 molded onto and around the periphery of window 18, which is blown to shape in an oven without a mold from thick transparent plastic sheet material. Base 12, including the basic shape of chair 14, bottom 28, curved front 30, back 32 and its peripheral edges 36 and 38, is molded integrally from FRP. Included in this molding is a back support 62 and a seat support 64 (FIGS. 2 and 3) of chair 14 and a foot-well or floor 66 in front of chair 14. Chair 14 is completed by a back cushion 68 fitted on back support 62 and a seat cushion 70 fitted on seat support 64. The peripheral area of base 12 inboard of canopy 16 (when closed) is shaped so as to provide a peripheral land 44*a* against which seal strip 44 can rest and form a sealing engagement. Thus, closure of the canopy 16 onto the upper part of base 12 forms a hermetically sealed enclosure, except for the provision of inlet slots 72 for the pressurized air at the top of seat back support 62 and the provision of a pressure-regulating exhaust valve 74 between the wall of foot well 66 and curved front 30 of bottom 28 of base 12. A pair of wheels 76 is provided toward the rear of bottom 28 to assist movement of capsule 10 and a pair of adjustable feet 78 is provided near the front of bottom 28 to stabilize the capsule once it is in position (see FIG. 3).

The latching mechanism will now be described in more detail with reference to FIGS. 4A-5B, which illustrate the engaging peripheries of base 12 and canopy 16 with most other parts removed. The periphery of base 12 incorporates a metal frame 80 that carries hook-like latches 50*a*-50*d* and half of hinge assembly 22. Similarly, the complementary periphery of canopy 16 incorporates a metal frame 82 that carries latch pins 52 and the other half of hinge assembly 22. Frames 80 and 82 are shown in the position for a closed canopy in the FIGS. 4A & 4C and in the position for a half-open canopy in FIG. 4B.

Hook-like latches 50*a*-50*c* are arranged in opposed pairs, one latch of each pair (eg, 50*a*) being located opposite the other on each side of the base frame, the latches of each pair being are fixed to respective ends of a common transverse shaft. Thus, latches 50*a* are mounted on each end of shaft 84*a*, latches 50*b* are mounted on each end of shaft 84*b* and latches 50*c* are mounted on each end of shaft 84*c*. Short bell-cranks 86*a*, 86*b* and 86*c* are fixed to the centers of shafts or rods 84*a*, 84*b* and 84*c* (respectively), the free end of crank 86*a* on shaft 84*a* being pivotally attached to a horizontal actuator rod 88. The free ends of cranks 86*b* and 86*c* on shafts 84*b* and 84*c* are pivotally attached to a common generally vertical actuator rod 90 behind the back of the chair (not shown). Rear end of rod 88 is pivotally linked to lower end of rod 90 by a bell-crank 92 that is mounted for rotational movement about a fixed transverse tie-rod 93, which—together with similar tie rods 94 and 95—serve to tie sides of frame 80 together. Upper extremity of actuator rod 90 is coupled to latches 50*d* by a push-rod 96. This arrangement ensures that all latches 50*a*-50*d* will operate in unison when motivated by handle 54 or 56, both of which are attached to shaft 84*c*. Internal handle 56 is secured to shaft 84*c* within a seal-tube tube 98 (FIG. 4A) that prevents air leakage along that handle from within the hyperbaric chamber.

Figure 5B:
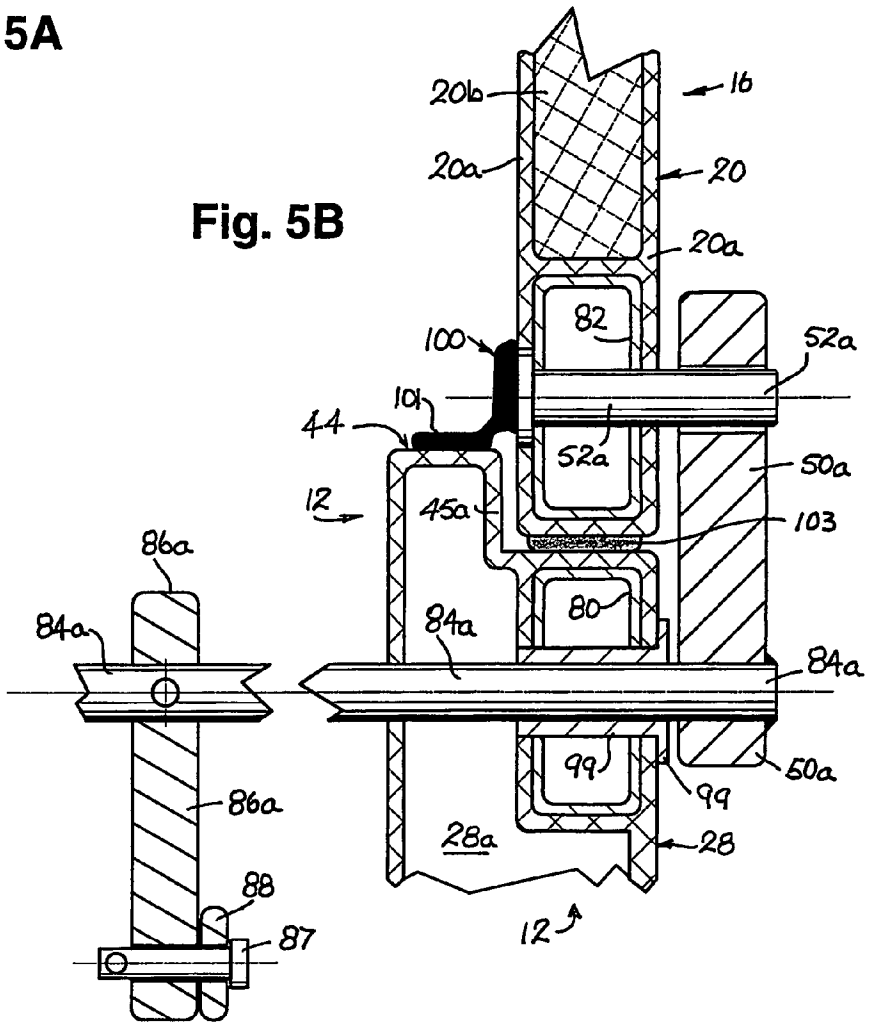
FIG. 5B is a sectional view of the latch and mechanism of FIG. 5A taken on section line V-V of FIG. 5A.
Figure 5A:
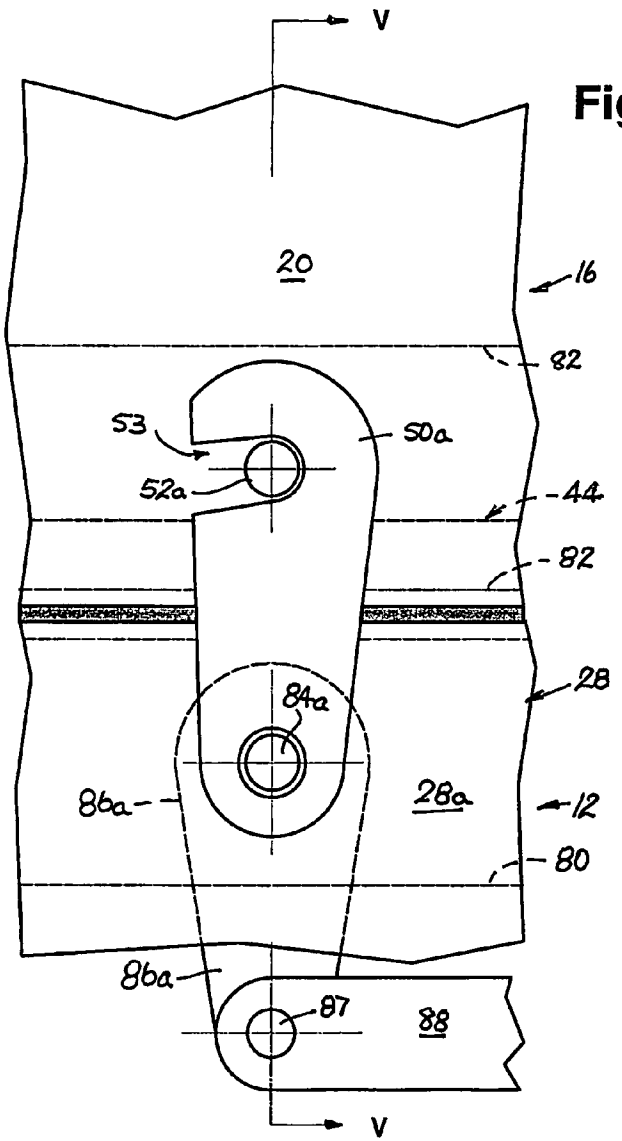
FIG. 5A is an enlarged elevational detail of one of the latches of the capsule of FIG. 1 in its closed or locked position, and showing portion of the latch operating mechanism.

The operation of hook-like latch 50*a* shown in FIG. 1 is illustrated in the detail views of FIGS. 5A-6B. As in FIG. 1, latch 50*a* is shown in FIGS. 5A and 5B engaged with latch pin 52*a* so that triangular side portion 20 of canopy 16 is locked to bottom portion 28 of base 12. It will be seen from FIG. 5A that the throat 53 of latch 50*a* slopes upwards toward latch pin 52*a*; that is, it has a re-entrant form such that, when upward force is applied to pin 52*a*, latch 50*a* tends to close further rather than open. As described with reference to FIGS. 4A-4C, latch 50*a* is fixed to one end of transverse shaft 84*a* that can be rotated by bell-crank 86*a* and actuator rod 88 to engage or disengage latch 50*a* with its pin 52*a*, rod 88 being pivotally attached to bell-crank 86*a* by pin 87. Canopy frame 82 is encased within a molded FRP wall 20*a* that has a foam core 20*b*. Similarly, frame member 80 of the bottom 28 of base 12 is encased in an FRP molding 28*a*, a bearing sleeve 99 being inserted into molding 28*a* and frame member 80 to carry shaft 84*a*.

Molding 28*a* forms the peripheral shoulder 45*a* on base portion 28 that, in turn, forms upwardly facing seal-line or surface 44. As shown in FIG. 5B, a sealing strip 100 (shown here in section) is glued to the inside of canopy side 20 near its bottom and has a flap 101 that rests on seal-line 44 of base portion 28. Under hyperbaric pressure within the chamber, flap is pressed onto seal-line 44 to hermetically seal the chamber. A cushion 103 is glued to the bottom edge of canopy side 20 to cushion the contact between that portion of canopy 16 and base 12 upon lowering of the canopy, cushion 103 not being intended to function as a seal.

It will be noted that the planar triangle-shaped canopy sides 20 will flex outwards toward latches 50*a* when the capsule is under pressure, stretching seal 100, until sides 20 contact latches 50*a*. The force thus applied to latches 50*a* will be transferred to transverse shaft 84*a*, which can readily be designed to carry such forces, being in tension. The same considerations apply to pairs of latches 50*b* and 50*c*, which are carried by shafts 84*b* and 84*c*, as described with respect to FIGS. 4A-4C, above.

Figure 6B:
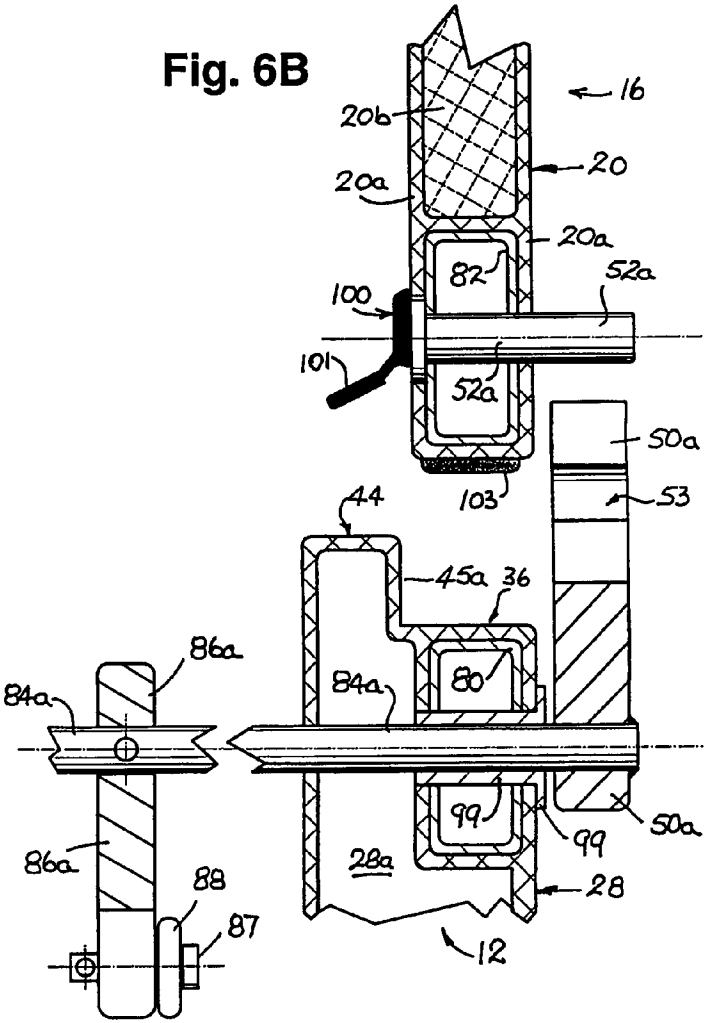
FIG. 6B is a sectional view of the latch and mechanism of FIG. 6B taken on section line VI-VI of FIG. 6A.
Figure 6A:
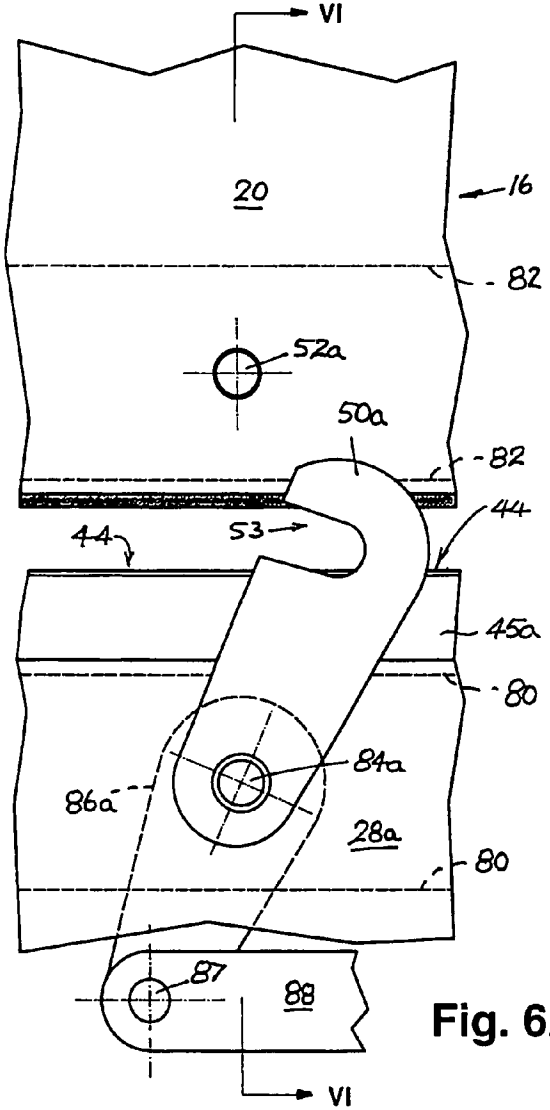
FIG. 6A is an elevational detail of the latch and mechanism of FIG. 5A shown in the open or unlatched position.

FIGS. 6A and 6B are similar views to FIGS. 5A and 5B respectively and show side 20 of canopy 16 slightly raised from bottom 28 of base 12. In FIGS. 6A and 6B latch 50*a* is shown in the open position, having been moved by a pushing force applied to rod 88 that rotates bell-crank 86*a*, shaft 84*a* and hook-like latch 50*a* in the clockwise direction.

Figure 7:
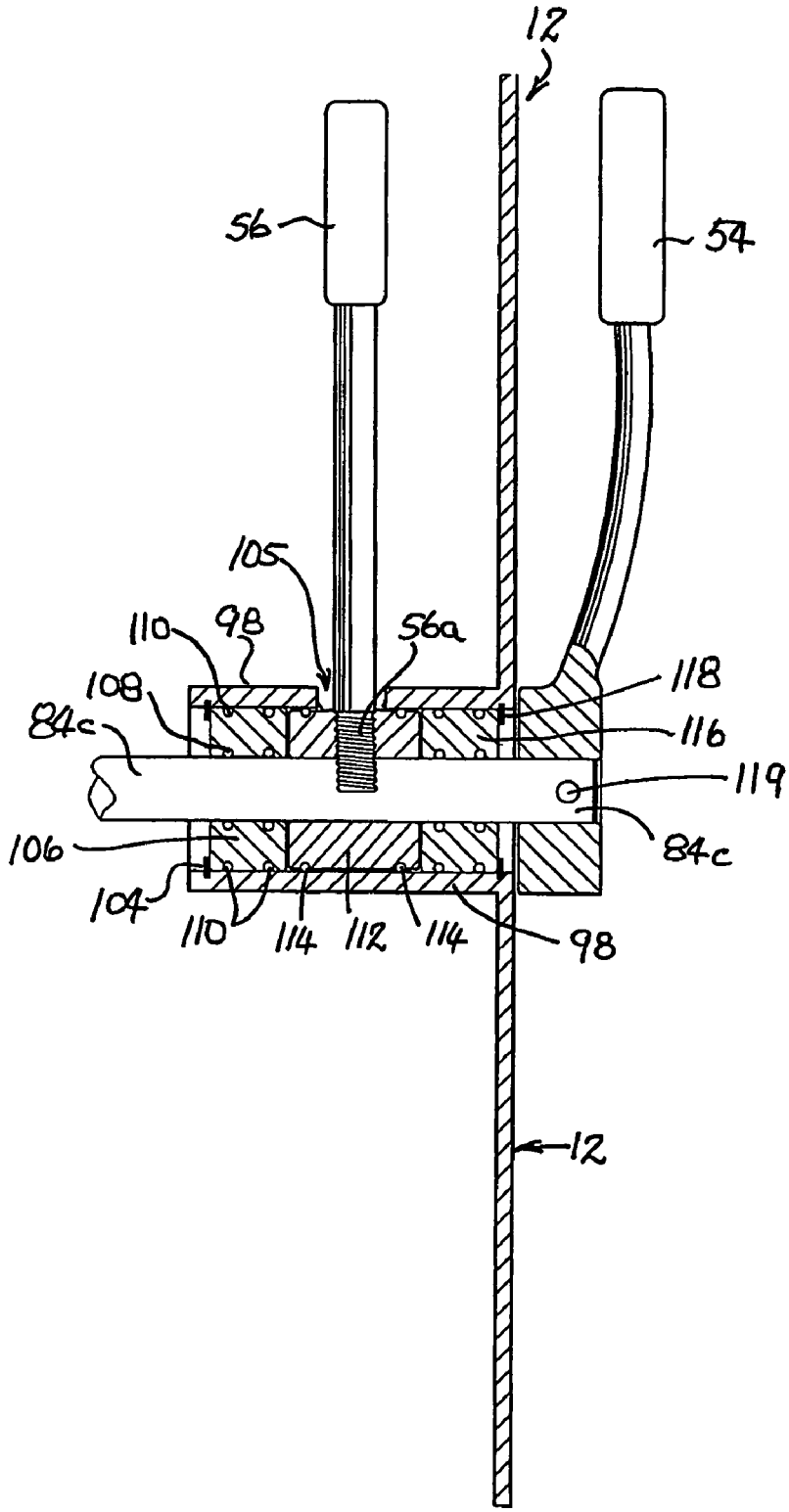
FIG. 7 is a sectional detail through the base and the actuator handle showing the manner in which the internal and external handles are connected.

FIG. 7 is a sectional view illustrating one way in which the internal and external actuator handles 56 and 54 may be arranged on the common shaft 84*c* in a manner that maintains the desired hermetic seal of canopy-to-base of the capsule. An open-ended bearing tube 98 is molded into the side of back 32 of base 12 to house shaft 84*c*, the inner end of tube 98 being fitted with a C-clip 104. The central periphery of tube 98 is slotted at 105 to accommodate handle 56 and allow the handle to be moved through a sufficient angle to permit operation of latches 50*a*-50*d*. With shaft 84*c* in place (ie, passing through) tube 98, an inner bearing 106 for shaft 84*c* is pushed into tube 98 from its external end along shaft 84*c* until it abuts C-clip 104, bearing 106 being fitted with a pair of inner O-rings 108 to sealingly engage shaft 84*c* and an outer pair of O-rings 110 to engage the bore of tube 98. Next, a hub 112 is pushed along shaft 84*c* into tube 104 until it abuts bearing 106, hub 112 being cross-drilled and threaded to take a corresponding screw-thread 56*a* formed on the lower end of handle 56. Hub 112 has an O-ring 114 on each side of handle 56 to engage the bore of tube 104. An outer bearing 116 that is substantially the same as inner bearing 106 (including inner an outer O-rings) is then pushed into tube 104 along shaft 84*c* and the two bearings and hub are held in place by an outer C-clip 118. Finally, outer handle 54 is fitted to the outer end of shaft 84*c* by cross-pin 119 and inner handle 56 is screwed into hub 106 and into a depression formed in shaft 84*c* to ensure that handle 56 can rotate shaft 84*c*. It will be seen that, while shaft 84*c* is located outside the pressurized portion of capsule 10 and handle 56 is located inside, air cannot escape past the handle 56 out of tube 104 or along shaft 84*c*.

The pressurization, control and monitoring of the capsule of this example will now be described. In this example independent control and monitoring of the pressure, oxygen concentration (and/or $CO_2$ concentration), humidity and temperature of air in the capsule is provided. The need to be able to set the desired pressure in a hyperbaric chamber is, of course, obvious. However, the need to monitor for temperature, $CO_2$ and humidity is dictated by the fact that these variables can quickly rise to uncomfortable—even dangerous—levels in a capsule of small volume like that of the chosen example. If supplemental oxygenation is not used, oxygen monitoring is desirable to (i) ensure that the oxygen concentration of air in the capsule does not fall significantly below that of the atmosphere and (ii) to generate an alarm in the event of an excessive rise. When supplemental oxygenation is used, it may be via a mask or via oxygen injection into the pressurizing air. In that case, it is desirable to have a separate indicator of mask oxygen concentration, and the readings of $CO_2$ or oxygen concentration in the capsule air may then be of little significance. Control of pressure, temperature and humidity can be achieved by known air-conditioning techniques and apparatus, except for the need for an air pump or blower of higher than normal pressure.

Figure 8:
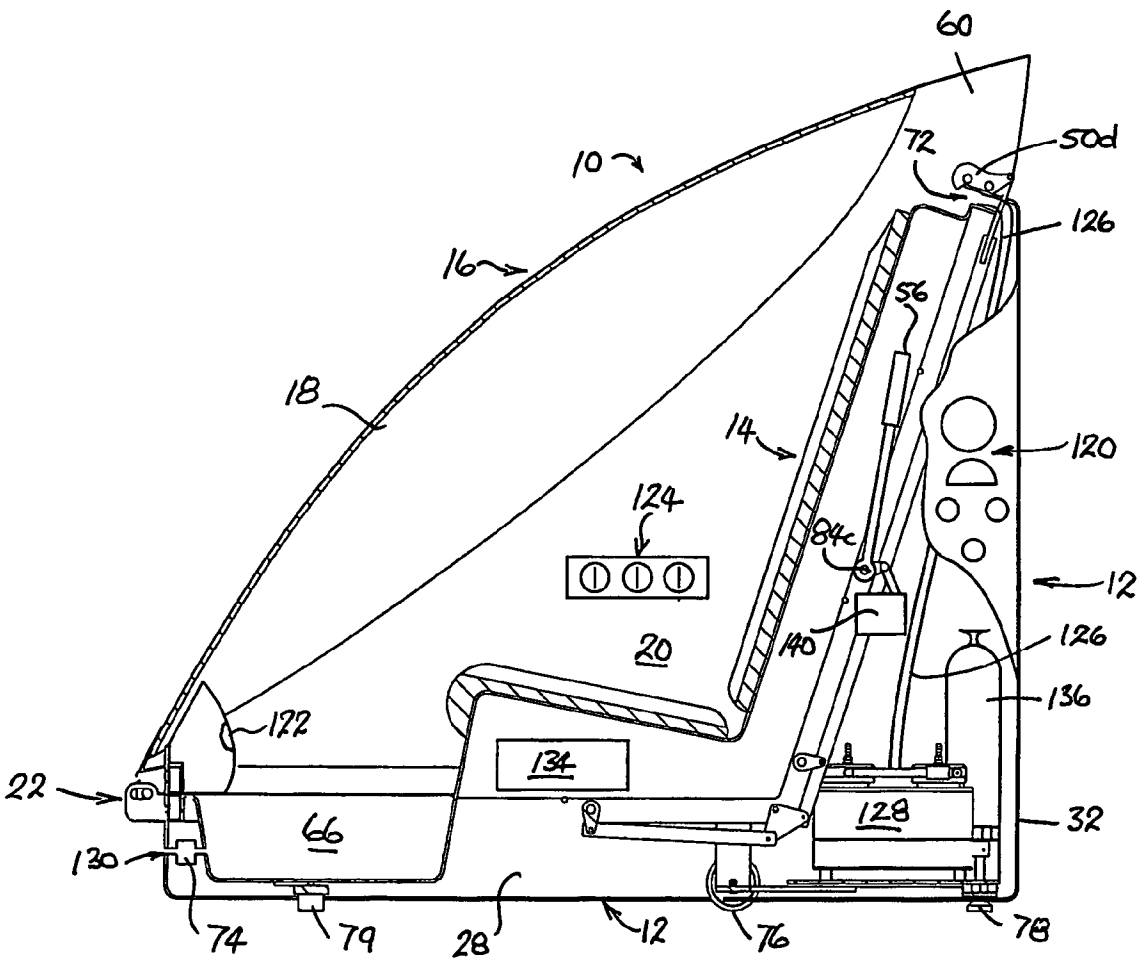
FIG. 8 is a sectional side elevation, taken on plane III-III of FIG. 1, showing the arrangement of the air supply system, controls, alarms and auxiliary equipment suitable for use with the chosen example.

FIG. 8 illustrates the basic arrangement of indicators and controls for the chosen example. An external set of indicators and controls is shown at 120 on the side of upright back 32 of base 12 of capsule 10. Internally, a set of indictors (comprising meters and alarms) is mounted in box 122 located at the bottom front of canopy 16 so as to face a seated user. A set of controls 124 is mounted on the inside of one of canopy panels 20 so as to be convenient for operation by the user. The internal indicators and controls 122 and 124 can duplicate the external indicators and controls 120. Cooled air is supplied to the interior of capsule 10 via a pipe 126 from an air-conditioning and pump unit 128 located at the bottom of the rear of base 12. Ideally, unit 128 can be controlled to vary air flow, relative humidity and temperature. The air inlet into the chamber comprises slots 72 (see also FIG. 3) located above the back of chair 14. A already noted, air from the hyperbaric chamber is exhausted in a controlled manner through throttle valve 74 and exhaust outlet 130. Pressure regulation is achieved by varying the relative rate at which air flows into and out of the chamber. This may be done by the use of a fixed air outflow rate and a variable air supply rate, a fixed inflow rate and a variable outflow rate, or by a combination of these methods. A controller unit 134, which accepts inputs from the sensors of monitoring unit 122 and user controls 124, is shown located under the seat of chair 14. FIG. 8 also shows an oxygen bottle 136 located in the back 32 of base 12, though no connections are shown to it. Oxygen from this bottle may be used to inject supplemental oxygen into to the input air in pipe 126 or it may be used to provide oxygen to a mask (not shown).

If desired, provision may be made for automatic depressurization and latch release in the event of power failure or excessive chamber air temperature, humidity or $CO_2$ concentration. Excessive $CO_2$ concentration and/or temperature can arise where air flow is too low due to malfunction or power failure and may not be noticed by the user in time to take remedial action. In this example, this safety feature is provided by:

(i) ensuring that power failure or the operation of the $CO_2$ alarm will deactivate air-conditioning and pump unit 128 and open inlet pipe 126 to atmosphere, (ii) fully open exhaust valve 74, if it is controllable (air will still exhaust from the chamber if valve is not controllable), and (iii) operate an automatic latch actuator unit 140 that is located in back 32 of base 12 and connected to shaft 84*c*.

Thus, as soon as the pressure within capsule 10 is equilibrated with atmospheric, the latches will be opened and struts 24 will pop the canopy open enough to ensure circulation of ambient air through the chamber.

Desirably, the $CO_2$ sensor, controller 134 and automatic actuator 140 should have sufficient standby battery power to operate in the event of power failure. However, the power requirement of actuator 140 may be too large for the standby battery suited to the sensors and controller, so spring, pneumatic or other energy storage means can be used to power unit 140.

Figure 9B:
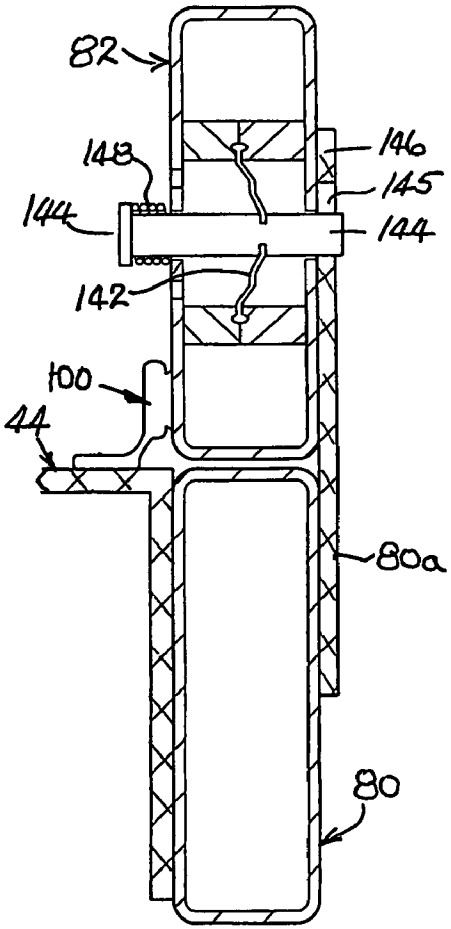
FIG. 9A is a sectional detail of a safety interlock in the locked position and FIG. 9B is the same view with the interlock in the unlocked position.
Figure 9A:
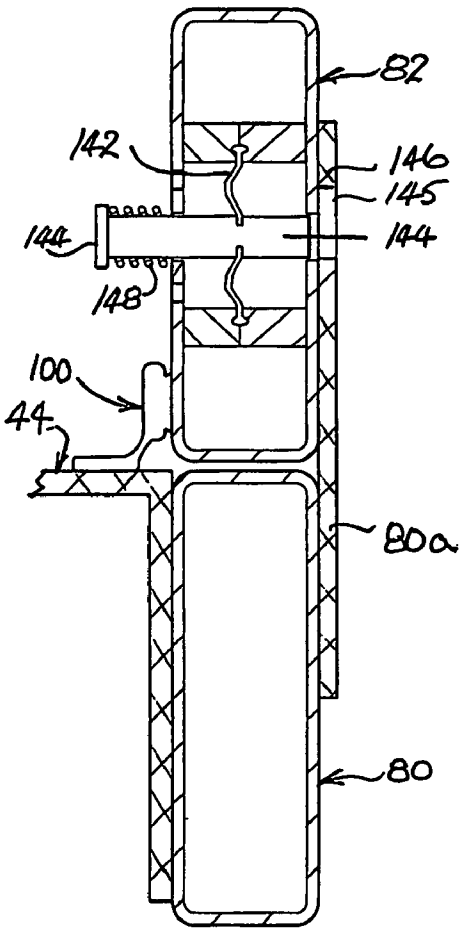

A further safety feature envisaged in a modified form of the chosen example is a pressure operated interlock that will prevent the canopy from being opened prematurely by the user. This may result in forceful and dangerous opening of the canopy if the user has sufficient strength to force internal handle 56 and release latches 50*a*-50*d*. A suitable safety interlock, located in canopy frame 82, is shown in FIGS. 9A and 9B, which illustrate a modified form of canopy and base. The interlock comprises a diaphragm 142 mounted in canopy frame 82, the diaphragm carrying a slide-bolt 144 for movement outwards to engage a slot 145 in a catch-plate 146 that is fixed to base frame 80. A spring 148 biases bolt 144 away from catch-plate 146 so that, if the chamber pressure approximates ambient air pressure, the capsule can be opened normally and without the need to touch bolt 144. On the other hand, if the chamber pressure is significantly higher than ambient, and if handle 56 is forced to prematurely open latches 50*a*-50*d*, the interaction of bolt 144 and slot 145 in catch-plate 146 will prevent the canopy from opening more than enough to ensure immediate pressure equalization. To fully open the canopy after operation of the latches in this way, where bolt 144 is still extended because of a fault, the user can manually withdraw bolt 144. There will be little resistance to this since the chamber is under no pressure.

The modified canopy side 20 and base bottom 28 shown in FIGS. 9A and 9B, illustrates another way in which the side forces of canopy sides 20 can be restrained. This is through the side plates 146 that can be placed at intervals around the periphery of the base, as needed, though more than one interlock bolt will not be normally be needed. It will also be seen that the manner in which the seal-line or surface 44 is formed can be varied as desired. Different forms of seal-strip may also be used, though that illustrated is of the same section as strip 100 shown in FIGS. 5B and 6B (and it has been referenced accordingly).

Figure 10B:
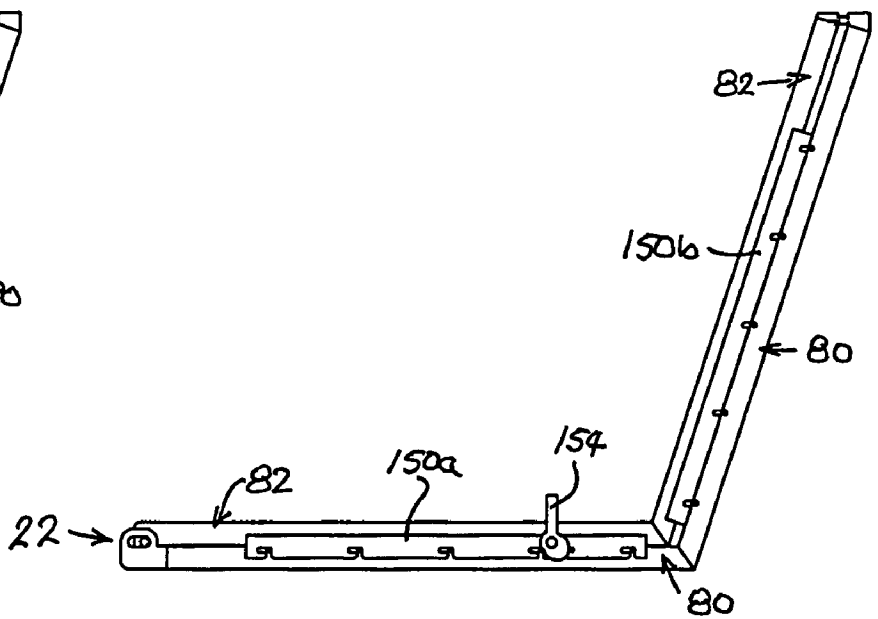
FIG. 10B is a similar view to that of FIG. 10A with the canopy and base frames in the closed position.
Figure 10A:
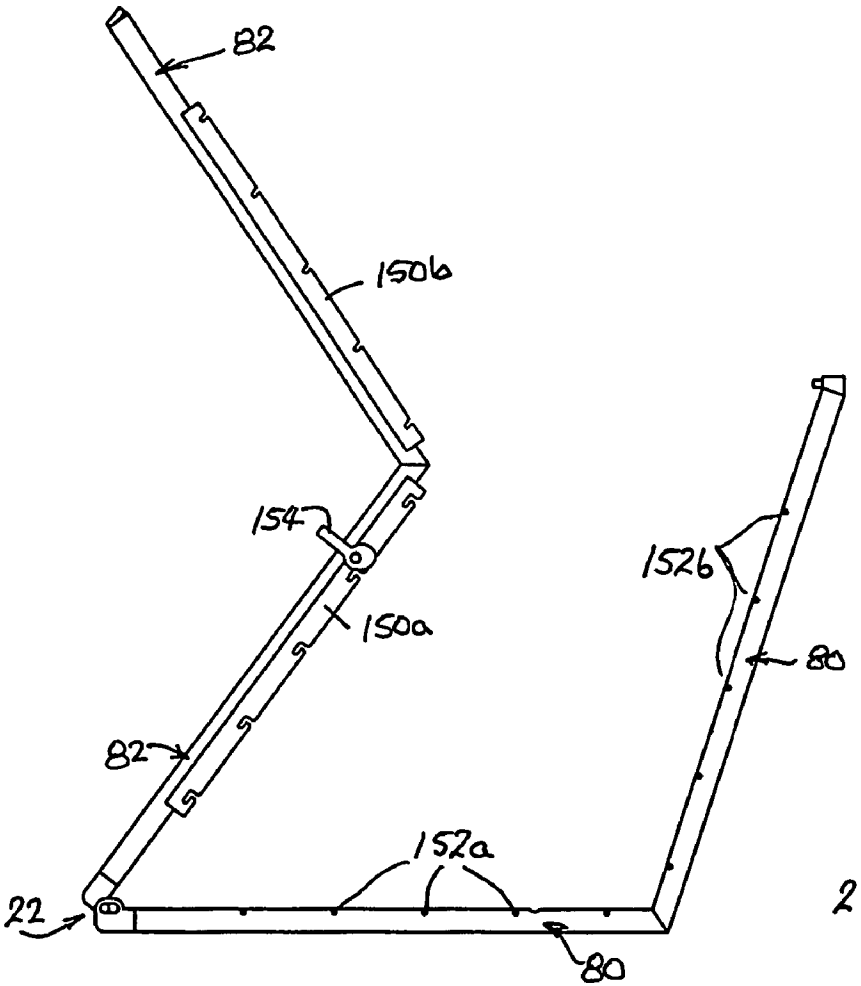

Other variations of the latching mechanism may also be employed. Some of these are shown in FIGS. 10A-11B. In the variant of FIG. 10, each side of canopy frame 82 carries two sliding notched latch plates 150*a* and 150*b* that engage respective rows of latch pins 152*a* and 152*b* located on each side of base frame 80. The sliding plates 150*a* are on the bottom edge of canopy 82 and are moved backwards and forwards by an actuator lever 154 and are coupled (by means not shown) to upper sliding plates 150*b* so that all plates move in unison to engage and disengage latch pins 152*a* and 152*b*. FIG. 10A shows the frames in the open position and FIG. 10B shows the frames in the closed position.

Figure 11B:
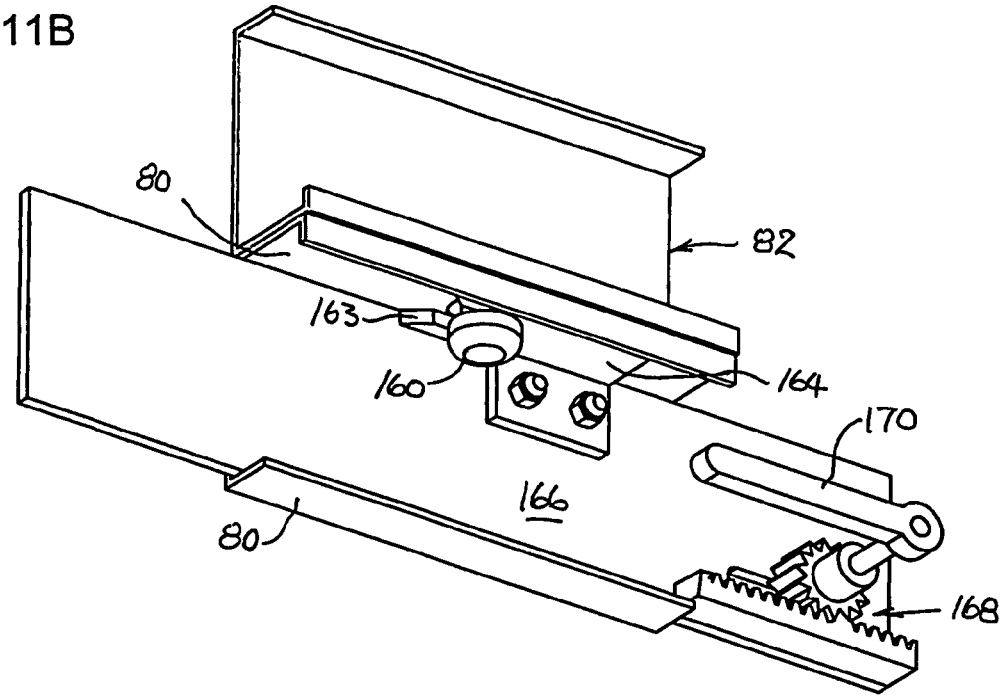
FIG. 11B is a similar view to that of FIG. 11A with the canopy and base frames in the open position.
Figure 11A:
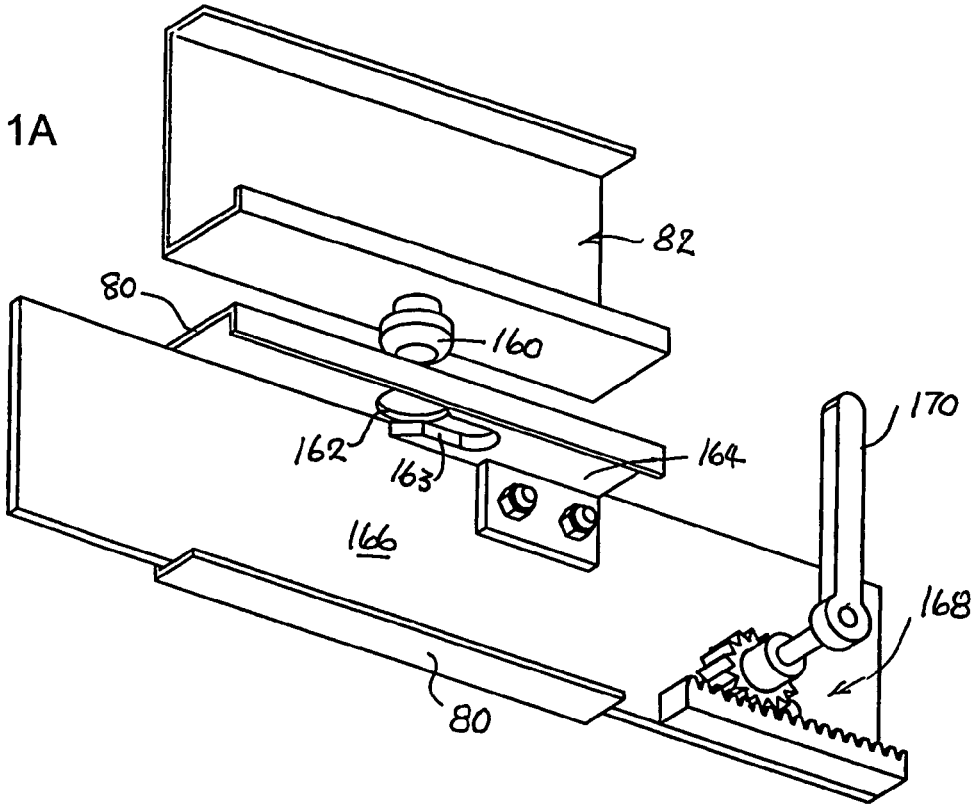

The second variant, shown in FIGS. 11 and 11B, has mushroom-headed latch pins 160 depending from the bottom of canopy frame 82 that pass and project through holes 162 in base frame 80. Each latch pin 160 can be engaged by an open ended slot 163 in a locking plate 164 to prevent its withdrawal through hole 162. Locking plate 164 is fixed by bolts 165 to a carrier plate 166 that can be reciprocated with respect to base frame 80 by a rack and pinion mechanism 168 that is operated by an actuator lever 170. FIG. 11A shows canopy frame 82 removed a little way from the base frame with latch plate 164 in the open or release position. FIG. 11B shows latch pin 160 engaged by slot 163 when the canopy (not shown) is in the closed position and latch plate 164 is in the locked position.

The invention claimed is:

1. A hyperbaric capsule comprising:

an elongate base molding which forms a forward-facing chair for a user, the chair having a seat and a back rising from the seat, the base molding having a front portion that extends forward of the chair seat at user foot level, and a rear portion that extends upwardly above the back of the chair and above user head level, said base molding defining a peripheral seal-line that extends around the front portion and along each side of the chair around the rear portion;

an elongate canopy extending forward and downward from above user head level at said back portion of the base to said front portion of the base, the canopy having an elongate transparent window formed therein, the canopy configured to be moveable between an open position, where a user can freely move to the chair from a side of the capsule, and a closed position, where a seated user is fully enclosed by the base and the canopy, the canopy defining a peripheral seal-line that is adapted to engage with said base seal-line to form an air-tight seal between the canopy and the base when the canopy is in the closed position;

pressurization means for pressurizing the capsule when said canopy is in the closed position; and a pressure regulator configured to operatively regulate pressure inside the capsule when the canopy is in the closed position.

2. A hyperbaric capsule according to claim 1 wherein:

said canopy has a convex external surface that is curved both front-to-back and side-to-side, said window also has a convex outer external surface that is curved both front-to-back and side-to-side, and said window extends at least from user head level to the level of the seat of the chair, when the canopy is closed.

3. A hyperbaric capsule according to claim 1, having:

latching means operable from both within and outside the capsule for securing the canopy to the base when the canopy is in the closed position to permit pressurization of the capsule, and for releasing the canopy from the base for movement to the open position.

4. A hyperbaric capsule according to claim 3 wherein said latching means includes:

a plurality of latches spaced around said peripheral seal-line of the base, a plurality of latch pins spaced around said peripheral seal-line of the canopy for engagement by respective latches, inside actuator means operable from inside the capsule when the canopy is in the closed position to secure and release all said latches in unison, and outside actuator means operable from outside the capsule when the canopy is in the closed position to secure and release all said latches in unison.

5. A hyperbaric capsule according to claim 4 wherein:

said latches include hook members moveable between a secure position, in which said hook members engage respective latch pins when the canopy is in the closed position, and a release position, in which said members disengage the respective latch pins, and said hook members have an over-center action whereby an opening force applied to the canopy, when said hook members are in said secure position, acts to bias said hook members toward the secure position, thereby inhibiting operation of said inside and outside actuator means when the capsule is under pressure.

6. A hyperbaric capsule according to claim 4 wherein:

the base has a first U-shape periphery which is generally horizontal and which defines a first portion of said base seal-line, said first U-shape periphery extends from below the seat on each side of the chair and around said front portion of the base, the base has a second U-shape periphery which is generally vertical and which defines a second portion of said base seal-line, said second U-shape periphery is in the form of an inverted U that extends from below the seat on each side of the chair and over the back of the chair, said first U-shape periphery and said second U-shape periphery join at a given angle below the seat, completing said base seal-line, the canopy includes two opposed downwardly extending side portions of generally triangular form, each side portion of the canopy forms a canopy angle that is substantially equal to said given angle, each side portion also defining portion of said canopy seal-line, and the side portions of the canopy fit into said join of the first and second U- shape peripheries on each side of the capsule when the canopy is in the closed position.

7. A hyperbaric capsule according to claim 6 wherein:

said hook members are located externally each side of the base near the chair and near said join, said latch pins are located on and externally of said side portions of the canopy and are arranged for engagement by said externally located hook members.

8. A hyperbaric capsule according to claim 7 wherein:

said externally located hook members are arranged in opposed pairs, the hook members of each of said pairs are fixed to respective ends of a common substantially horizontal shaft that extends transversely through the base molding, the hook members of each pair being movable by rotation of their respective shaft to engage and release their respective latch pins on the side portions of the canopy, outward movement of the side portions of the canopy under pressure is resisted by abutment of the side portions with the hook members of a pair and tension within their respective shaft.

9. A hyperbaric capsule according to claim 8, wherein, the canopy is hingedly attached to the base so that, when the canopy is in the closed position, at least part of the side portions of the canopy lies inwards of said first and second U-shaped peripheries of the base on each side of the capsule, whereby outward movement of said side portions of the canopy under pressure is resisted by said first and second U-shaped peripheries of the base.

10. A hyperbaric capsule according to claim 1, wherein:

the canopy is hingedly attached to the front portion of the base for movement about a transverse horizontal axis, and gas struts are fitted between the canopy and the base on each side of the front portion of the base to counterbalance a weight of the canopy when open or when being opened.

11. A hyperbaric capsule according to claim 1, wherein a pressure-operated lock is provided to prevent the opening of the canopy while there is super-atmospheric pressure within the capsule.

12. A hyperbaric capsule according to claim 1 having a temperature indicator within the capsule adapted to indicate the temperature of pressurised air supplied to the capsule via the pressurization means.

13. A hyperbaric capsule according to claim 1 having:

monitoring means adapted to monitor the $CO_2$ concentration of air within the capsule, and alarm means connected to said monitoring means adapted to signal the user when a predetermined concentration of $CO_2$ is reached.

14. A hyperbaric capsule according to claim 13 having emergency release means operable to effect automatic depressurization of the capsule and automatic release of said canopy to the open position when the predetermined concentration of $CO_2$ is reached.

15. A hyperbaric chamber according to claim 1 having oxygen supply means adapted to supply oxygen gas at hyperbaric pressure to a user within the capsule, said oxygen supply means including a face mask by which oxygen enriched air can be supplied to a user seated and enclosed within the capsule.

16. A hyperbaric chamber according to claim 1, wherein:

a width of the capsule is less than that of a standard door frame, and the base is fitted with wheels or rollers by which the capsule can be moved to or transported within a domestic location.

17. A hyperbaric capsule according to claim 1, wherein the pressurization means includes an air-conditioning and pump unit located at a bottom rear-end of the base.

18. A hyperbaric capsule according to claim 1, wherein the pressure regulator includes a throttle valve operated to control air exiting the capsule.

* * * * *